US005686875A

United States Patent [19]

Bollen

[11] Patent Number: 5,686,875

[45] Date of Patent: Nov. 11, 1997

[54] MERCURY WETTED SWITCH

[75] Inventor: Romain François Bollen, Hasselt, Belgium

[73] Assignee: C. P. Clare Corporation, Beverly, Mass.

[21] Appl. No.: 647,692

[22] Filed: May 13, 1996

Related U.S. Application Data

[63] Continuation of Ser. No. 302,734, Aug. 30, 1994, Pat. No. 5,517,166.

[51] Int. Cl.[6] ..... H01H 1/08

[52] U.S. Cl. ..... 335/58

[58] Field of Search ..... 335/51–58, 151–154

[56] References Cited

U.S. PATENT DOCUMENTS

| | | | |
|---|---|---|---|
| 3,482,071 | 12/1969 | Miller | 335/58 |
| 4,134,088 | 1/1979 | Asbell et al. | 335/51 |
| 4,260,970 | 4/1981 | Bitko | 335/52 |
| 5,517,166 | 5/1996 | Bollen | 335/58 |

FOREIGN PATENT DOCUMENTS

| | | |
|---|---|---|
| 1 173 162 | 7/1964 | Germany . |
| 1 514 689 | 6/1969 | Germany . |
| 2 226 573 | 12/1973 | Germany . |
| WO 90/02409 | 3/1990 | WIPO . |

*Primary Examiner*—Lincoln Donovan
*Attorney, Agent, or Firm*—Lappin & Kusmer LLP

[57] ABSTRACT

A switch assembly comprising a housing including a baseplate on which are mounted a magnet core having a pair of flanges and a winding wound around it, and two switch capsules positioned on either sides of the magnetic core with each capsule being insulated from each flange magnetic core by insulating means. Magnets are also positioned to provide either a monostable or a bistable mode of operation as desired. With this construction, the magnetic and electric paths in the assembly are physically separate from one another, thereby allowing the magnetic and electric materials to be chosen independently from each other.

13 Claims, 2 Drawing Sheets

MERCURY WETTED SWITCH

This application is a continuation of application Ser. No. 08/302,734 filed Aug. 30, 1994 now U.S. Pat. No. 5,5517, 166.

FIELD OF THE INVENTION

The present invention relates to a mercury wetted switch assembly which is capable of operation in any position.

BACKGROUND OF THE INVENTION

A typical mercury wetted switch comprises a sealed glass capsule in which there is mounted a movable armature having a pair of pole ends for alternately contacting a respective electric contact when the armature is pivoting and the surface of the armature is wetted with a film of mercury. An energizing coil is provided to generate magnetic field in the magnetic conducting parts in order to generate a magnetic force which tends to operate the switch. The mode of operation, either monostable or bistable, is creating by externally positioning one or two permanent magnets to the capsule.

The reeds used in the capsule for making the switching contacts are to be made of a material that must be carefully chosen in order to meet three requirements:

1) it must be optimally magnetic conducting, 2) it must be optimally electric conducting, 3) it must have an expansion coefficient that is compatible with that of glass. paths in the assembly are physically separated from one another, thereby allowing the magnetic and electric materials to be chosen independently from each other.

DESCRIPTION OF AN EXEMPLARY EMBODIMENT

Figure 1:
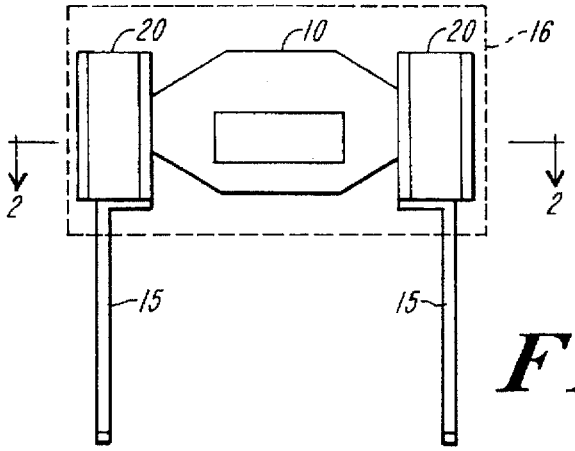
FIG. 1 is a front view of an exemplary embodiment of the such assembly in accordance with the invention.
Figure 2:
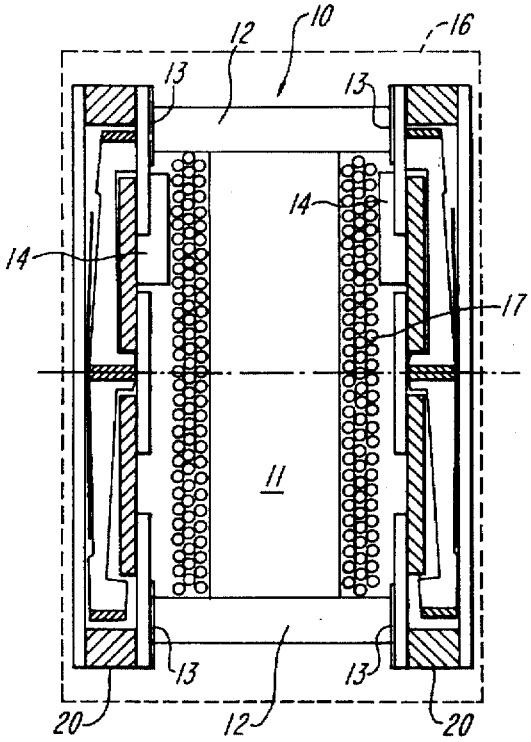
FIG. 2 is a cross-sectional view along line II—II in FIG. 1.
Figure 3:
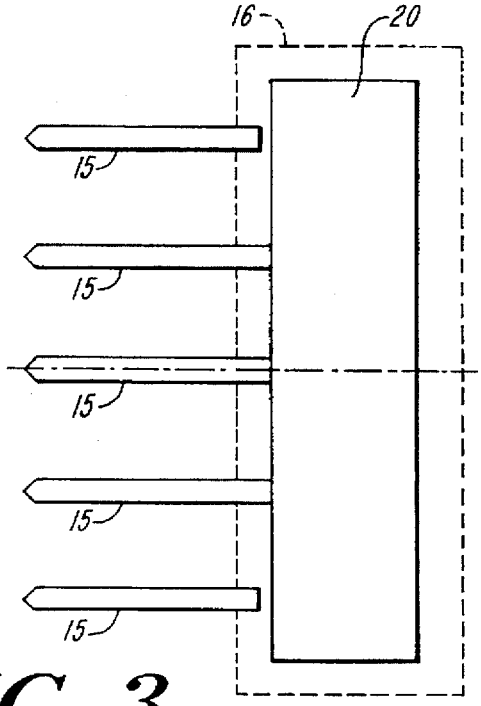
FIG. 3 is a side view of the switch assembly of FIG. 1.
Figure 4:
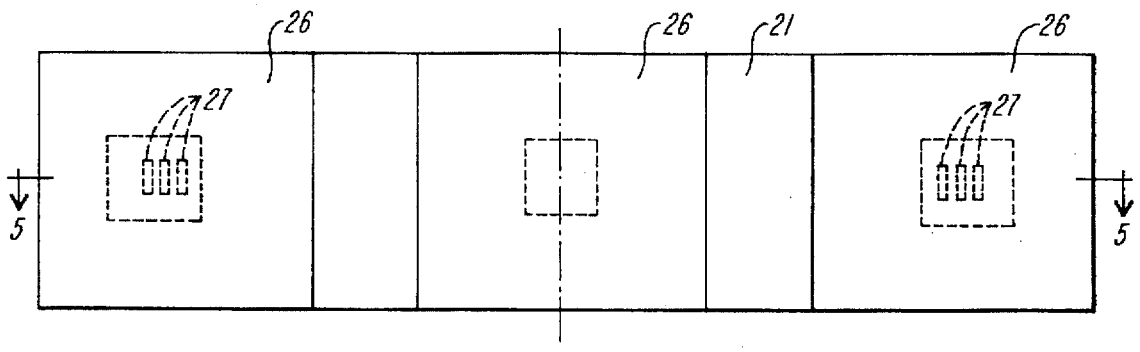
FIG. 4 is a bottom view of one of the capsules shown in FIG. 1.
Figure 5:
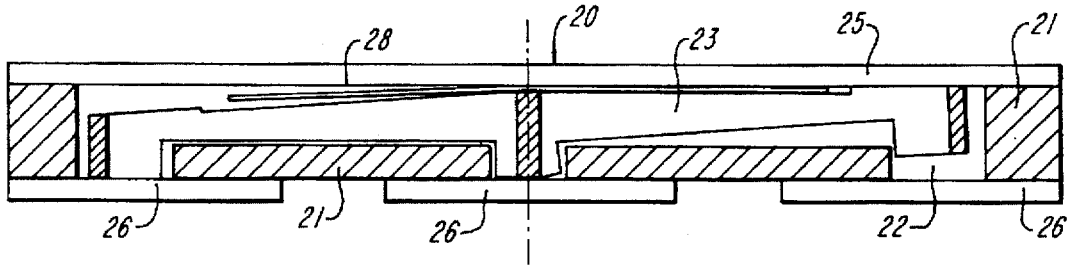
FIG. 5 is a cross-sectional view along line V—V in FIG. 4.
Figure 6:
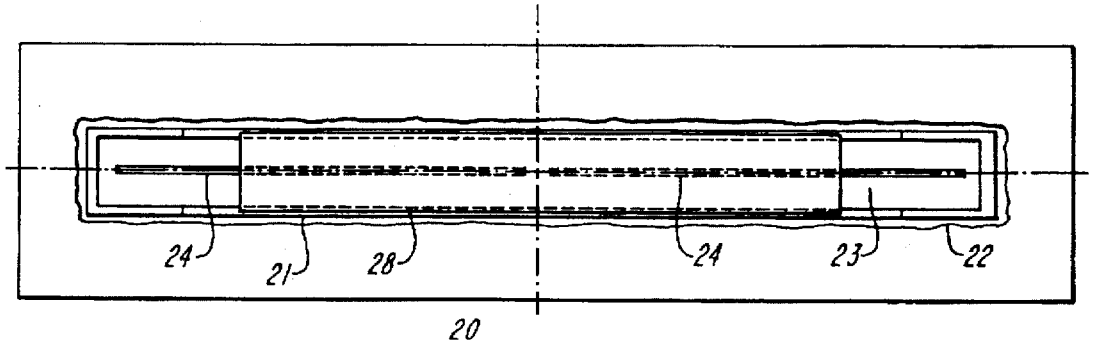
FIG. 6 is a partially stripped view of a capsule shown in FIG. 1.

Referring to FIGS. 1 and 2 it is shown that the switch assembly according to the invention essentially comprises a magnetic unit 10 and two switch capsules 20 which are mounted on either sides of the magnetic unit 10. The whole assembly is housed in an envelope or housing 16 with terminals 15 projecting therefrom.

The magnetic unit 10 includes a I-shaped magnetic core 11 having a winding 17 directly wound around it and end flanges 12 made of the same magnetic material. Each switch capsule 20 is insulated from the flanges pillary groove 24 formed therein for allowing mercury to be distributed to the switching areas. The terminals 15 are directly connected to the capsules 20 whereby these terminals are physically independent from the winding construction.

A magnet 14 is externally positioned to each capsule 20 thereby to provide a normal magnetic make position of the switch. Providing two magnets on the capsules makes it possible to secure a bistable mode of operation which requires a magnetic balance in the system.

I claim:

1. A switch comprising:

a housing with an interior region;

an electrically conductive cantilever beam disposed within the interior region and pivotable at a pivot, the pivot being connected to a first electrically conductive contact;

second and third electrically conductive contacts coupled to the interior region; and magnetic means, magnetically coupled to the cantilever beam, for controllably pivoting the cantilever beam between a first position in which the first electrically conductive contact is connected by the cantilever beam to the second electrically conductive contact and a second position in which the first electrically conductive contact is connected by the cantilever beam to the third electrically conductive contact.

2. The switch of claim 1, wherein the housing comprises a ceramic material.

3. The switch of claim 1, wherein the housing includes three openings for providing access to the cantilever beam within the interior region.

4. The switch of claim 3, wherein each of the electrically conductive contacts is mounted to the housing at one of the openings in the housing.

5. The switch of claim 1, wherein the cantilever beam is at least partially coated with mercury.

6. The switch of claim 1, wherein at least one of the conductive contacts is at least partially coated with mercury.

7. The switch of claim 1, wherein at least one of the electrically conductive contacts comprises a plurality of regions coated with mercury.

8. The switch of claim 1, further comprising a spring disposed within the interior region for biasing the cantilever beam toward one of the first and second positions.

9. The switch of claim 1, further comprising a magnet magnetically coupled to the cantilever beam to provide a magnetic force to the cantilever beam to bias the cantilever beam toward one of the first and second positions.

10. The switch of claim 1, wherein the magnetic means is electrically insulated from the cantilever beam and the contacts.

11. The switch of claim 1, wherein the magnetic means comprises a coil in proximity to the cantilever beam, the coil inducing a magnetic force to pivot the cantilever beam between the first and second positions.

12. The switch of claim 1, wherein the cantilever beam comprises a first end portion, a second end portion and a center pivot portion between the first and second end portions, the pivot portion being connected to the first electrically conductive contact and the cantilever beam being pivotable to connect one of the first and second end portions to a respective one of the second and third electrically conductive contacts.

13. The switch of claim 12, wherein the magnetic means comprises a coil in proximity to one of the first and second end portions of the cantilever beam.

* * * * *